US005735412A

United States Patent [19]

Sheckells

[11] Patent Number: 5,735,412

[45] Date of Patent: Apr. 7, 1998

[54] SELF-GRIPING RACK AND METHOD FOR STACKING ARTICLES WITH RACK

[76] Inventor: Amuel E. Sheckells, 2374 Old Wire Rd., Meridian, Mich. 39301

[21] Appl. No.: 651,489

[22] Filed: May 22, 1996

[51] Int. Cl.[6] ..... B65D 85/20

[52] U.S. Cl. ..... 211/59.4; 211/60.1; 248/68.1; 248/154; 206/443; 410/42; 410/49

[58] Field of Search ..... 206/443, 821, 206/446, 504, 506, 503; 220/23.6; 410/32, 42, 36, 37, 49; 248/154, 68.1; 211/59.4, 60.1

[56] References Cited

U.S. PATENT DOCUMENTS

| | | | |
|---|---|---|---|
| 1,921,228 | 8/1933 | Hetherington . | |
| 2,662,649 | 12/1953 | Gill et al. | 206/821 X |
| 2,958,492 | 11/1960 | Maynard . | |
| 3,019,916 | 2/1962 | Malcher | 206/446 X |
| 3,237,786 | 3/1966 | Milliken . | |
| 3,283,893 | 11/1966 | Durocher et al. | 206/443 |
| 3,388,792 | 6/1968 | Jones . | |
| 3,402,904 | 9/1968 | Parskewik . | |
| 3,430,981 | 3/1969 | Tarantola | 410/49 |
| 3,627,300 | 12/1971 | Caveney et al. | 248/68.1 X |
| 3,977,486 | 8/1976 | Kleinschmit | 248/68.1 X |
| 4,099,617 | 7/1978 | Nist, Jr. | 206/443 |
| 4,175,666 | 11/1979 | Smith . | |
| 4,244,542 | 1/1981 | Mathews | 248/68.1 X |
| 4,407,472 | 10/1983 | Beck | 248/68.1 X |
| 4,618,114 | 10/1986 | McFarland | 248/68.1 X |
| 4,685,846 | 8/1987 | Golay et al. . | |
| 4,744,708 | 5/1988 | Cochrane . | |
| 5,516,244 | 5/1996 | Baka | 410/42 X |

FOREIGN PATENT DOCUMENTS

| | | | |
|---|---|---|---|
| 2208139 | 8/1973 | Germany | 206/443 |
| 532207 | 1/1941 | United Kingdom | 206/446 |
| 561423 | 5/1944 | United Kingdom | 206/446 |
| 2229169 | 9/1990 | United Kingdom | 206/446 |

*Primary Examiner*—Derek J. Berger
*Assistant Examiner*—Donald J. Wallace
*Attorney, Agent, or Firm*—Birch, Stewart, Kolasch & Birch, LLP

[57] ABSTRACT

A stack is formed by a rack having a plurality of holders. A first flexible holder is provided between two adjacent rigid holders. First and second articles are placed on a support and are spaced a pre-determined distance. The rigid second and third holders are placed on top of the first and second articles. A third article is then placed in the first flexible holder between the rigid second and third holders. The weight of the third article on the first flexible holder will cause the second and third rigid holders to move into clamping engagement with sides of the third article. Additional articles can then be placed on the stack. This arrangement provides for a self-gripping rack and article combination.

44 Claims, 4 Drawing Sheets

SELF-GRIPING RACK AND METHOD FOR STACKING ARTICLES WITH RACK

BACKGROUND OF THE INVENTION

1. Field of the Invention

The present invention relates to a self-gripping flexible rack for stacking article such as propane tanks. A method is further disclosed for stacking articles using this rack.

2. Description of the Background Art

Various racks are known for stacking and transporting articles such as propane tanks. When transporting 500-gallon tanks, known systems can normally only load 4 tanks onto a truck due to legally imposed vehicle load sizes. Also, existing propane tank racks are bulky and relatively heavy. Therefore, when such racks are loaded onto a vehicle for transporting the propane tanks, the racks will increase fuel consumption and therefore increase shipping costs. Existing racks can also be difficult to load and unload and can take up a lot of storage space. Some existing racks are also unsatisfactory for use on vehicles when transporting propane tanks because the articles will not be securely held.

Accordingly, there is a need in the art for a simple and effective rack for holding articles such as propane tanks. This rack should increase the number of articles which can legally be carried on a vehicle. In other words, the number of tanks which can fit within a defined boundary needs to be increased. The need also exists for a lightweight, easy to use, safe rack for storing and shipping article such as propane tanks.

SUMMARY OF THE INVENTION

Accordingly, it is a primary object of the present invention to provide a rack which will increase the number of articles, such as propane tanks, which can be held within a pre-defined boundary.

A further object of the present invention is to provide a rack in which articles, such as propane tanks, can be shipped without damage.

Another object of the present invention is to provide a rack which is light-weight and which can easily be loaded and unloaded.

Yet another object of the present is to provide a rack which will safely hold a load, even on a moving vehicle.

Still a further object of the present invention is to provide a method for stacking and/or shipping articles whereby the number of articles, such as propane tanks, in a pre-defined space can be increased, the articles can be easily stacked and unstacked, and the articles can be safely shipped after they are placed in the stack.

These and other objects of the present invention are fulfilled by providing a rack with a plurality of holders for receiving articles in seats thereon. The first holder is positioned between the second and third holder. The first holder has a seat facing a first direction while the second and third holders each have at least one seat facing a second direction. The first and second directions are opposite to one another. The first holder is flexible while the second and third holders are rigid.

These and other objects of the present invention are further fulfilled by a self-gripping rack and article combination. This combination comprises flexible means for receiving an article. The flexible means includes a flexible strap with two ends. On each end of the flexible strap is clamping means. The clamping means will engage the article in the flexible strap in response to loading of the article on the strap. The clamping means includes a rigid clamping element having sides which engage the sides of the article. Seat means are provided on the clamping elements for receiving and holding additional articles.

Moreover, these and other objects of the present invention are fulfilled by a method for stacking articles comprising a step of placing a first article and a second article on a support. The first and second articles are spaced apart. Then, a clamping element is placed on top of each of the articles. The clamping element on each of the first and second articles will only engage a portion of their outer periphery. A flexible strap is provided between the two clamping elements and a third article is placed on this flexible strap. The third article can be clamped by the two clamping elements when they move into engagement with the sides of the third article.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 2:
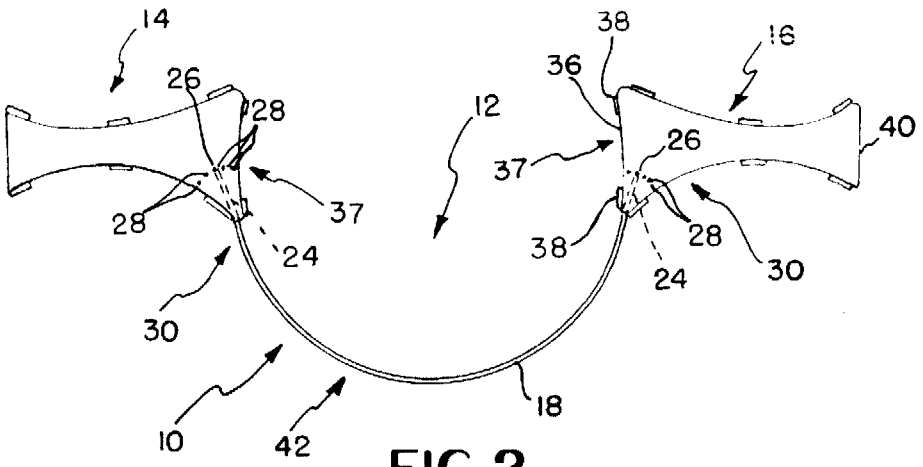
FIG. 2 is a side view of the rack of the present invention.
Figure 1:
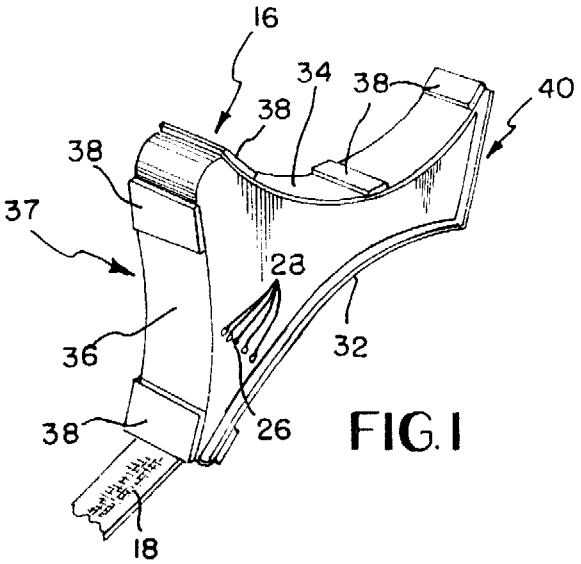
FIG. 1 is a perspective view of one of the clamping elements of a rack of the present invention.

Referring in detail to the drawings and with particular reference to FIGS. 1 and 2, a self-gripping rack 10 is shown. As seen in FIG. 2, this rack 10 includes a plurality of holders 12, 14 and 16. The first holder 12 is a flexible strap 18. The curvature of this flexible strap 18 forms a first seat. The second and third holders 14 and 16 are rigid and form clamping elements. An enlarged perspective view of the third holder 16 is shown in FIG. 1. It should be appreciated that the description of the third holder 16 is equally applicable to the second holder 14.

The flexible strap 18 extends from openings in the underside of the second and third holders 14 and 16. This strap 18 can have loops 24 at each of its ends. These loops will encircle a bolt 26 in each of the holders 14, 16. A plurality of holes 28 are provided in both sides of the second holder 14 and the third holder 16. While five holes 28 are shown in an arcuate pattern, any number of holes or positioning of holes can be used. A corresponding set of holes is provided on both sides of each holder 15, 16. The bolt 26 extends through the holes on each side of the holder 14 or 16 in order to be affixed in position. A nut can be used on the end of bolt 26 in order to lock the bolt in position. Of course, any other suitable fixing arrangement for strap 18 can be used.

By inserting the loops 24 into openings formed in the ends of the second and third holders 14,16, the bolts 26 can then be slipped through the loops 24 in order to hold the first holder 12 onto the second and third holders 14,16. As previously noted, five holes 28 are shown in an arcuate pattern. These different holes 28 will provide for adjustment of the length of the flexible strap 18. In other words, as this strap 18 elongates during use or if a different sized article is held by the first holder 12, the length of strap 18 can be adjusted by moving the bolt 26 to another hole 28. Therefore, the movable bolts act as means 30 for adjusting a length of a first holder 12.

In FIG. 1, the third holder 16 will be described in more detail. On the underside of this first holder 16, is a lower concave seat 32. On the upperside is an upper concave seat 34. These seats 32,34 are rigid and non-deformable. On the side of the third holder 16 is a clamping seat 36. This clamping seat 36 is part of clamping means 37. The clamping seat 36 is also a concave, non-deformable seat.

Each of the three seats, 32, 34 and 36 for the third holder 16 will have a plurality of pads 38 provided thereon. These pads may be neoprene support pads or any other suitable pads. They will engage and help to support and protect articles held by the holder 16. Three pads 38 are provided on the upper seat 34. While not shown in FIG. 1, three pads are also provided on the lower seat 32. These three pads can be seen in the modified embodiment of FIG. 5. This modified embodiment of FIG. 5 will be discussed later. Two pads 38 are provided on the clamping seat 36. Of course, any suitable arrangement and number of pads can be used.

The third holder 16 is made from aluminum or other light-weight material, for example. It is contemplated that this holder will be hollow in order to reduce its weight. Two one-eighth inch aluminum plates can be welded together with a curved upper plate forming the first seat 34, a curved lower plate forming the lower seat 32, a curved side plate forming the clamping seat 36 and a generally straight end piece 40. The two side plates can be about four inches apart. If the holder 16 were to be strengthened, they could be up to eight inches apart.

While the third holder 16 has been described in detail, it is again noted that the second holder 14 has a similar structure. Pads 38 and rigid non-deformable seats 32, 34, 36 are provided on this second holder 14. As indicated in FIG. 2, the second and third holders 14,16 are mirror images of one another. It should further be appreciated that the bolt 26 and nut arrangement can be inserted such that the nut is on the same side of the second holder 14 as it is on the third holder 16 or inserted to be on an opposite side. When seen in a view perpendicular to FIG. 2 (an end view), the holders 12, 14 and 16 are linearly aligned.

The strap 18 is made from a flexible material such as nylon or flexible metal. Plastic, nylon, polyester material, fabric or any other suitable material can be used on the metal strap or can be used in place of the metal strap. It is merely necessary that this strap 18 have a sufficient strength to hold an article which is placed thereon as will be described in more detail below. It is contemplated that each strap can have a thickness of one-eigth of an inch and that two straps will extend between holders 14,16 with a total width of the first holder 12 therefore being one-fourth of an inch. Accordingly, this first holder 12 is relatively thin.

Figure 3:
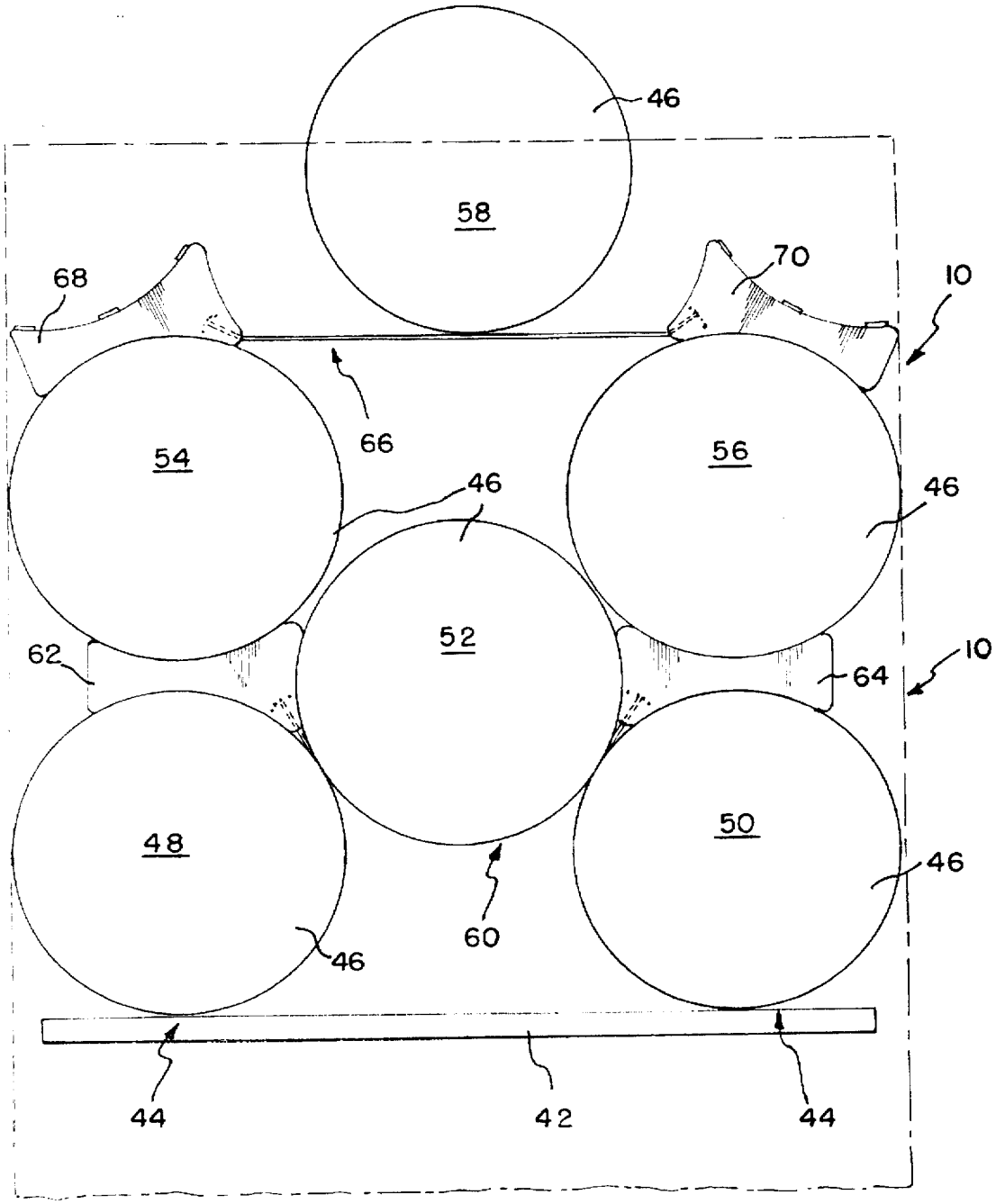
FIG. 3 is an end view in which a sixth article is being loaded on a stack utilizing racks of the present invention.

Turning now to FIG. 3, loading of articles onto the rack 10 will be described in more detail. It is contemplated that propane tanks can be held in this rack 10 but it should be appreciated that any suitable article can be received therein. Moreover, while the instant disclosure discusses handling cylindrical objects such as propane tanks, it should be contemplated that any shaped article can be held using the principles of the rack in the present invention.

When holding whatever articles, the flexible strap 18 of the first holder 12 forms flexible means 42 for holding the article. The clamping seats 36 on the second and third holders 14,16 act as rigid clamping elements to form clamping means 37. At least the upper and lower seats 34,32 on each holder 14,16 act as seat means for receiving and holding articles. It should be noted that an article held on the lower seats 32 of the second and third holders 14,16 would be on an opposite side of the rack 10 from an article held in the flexible seat of the flexible strap 18. In other words, the seat formed by the flexible strap 18 faces a first direction, upwardly, while the lower seats 32 face a second direction, downwardly.

In FIG. 3, an arrangement using a plurality of racks 10 will now be described. In this arrangement 10, a support 42 is provided. This support 42 has indentations 44 which conform to the shape of articles 46 to be held thereby. In the arrangement shown in FIG. 3, two lowermost, cylindrical articles 48, 50 are provided. Therefore, two arcuate indentations 44 are provided. However, it should be contemplated that any number of indentations 44 corresponding to the number of articles can be provided for support 42. Moreover, this support 42 can be omitted if so desired. In such a case, the lowermost articles in a stack would be placed directly on the underlying surface.

In forming the stack of articles, a first article 48 is placed on support 42. Then a second article 50 is placed on support 42. The two articles 48,50 are spaced from one another. A first rack 10 is then placed on top of the two articles 48,50. This first rack 10 has first, second and third holders 60, 62 and 64. Basically, the first holder 60 is a flexible strap corresponding to the previously described holder 12 while the second and third holders 62,64 are rigid clamping elements corresponding to the previously described holders 14,16. A different designation is used merely to distinguish the holders of the first lowermost rack from those of an upper rack to be described below. The first lowermost rack is made up of these holders 60, 62 and 64.

After the clamping elements 62,64 are placed on articles 48,50, a third article 52 can be loaded on the first holder 60. In the embodiment shown, this first holder 60 is a strap made of flexible material. It can deform in order to form a concave seat. In other words, the weight of the article 52 will cause the first holder to conform to the article's convex shape. Loading of article 52 into holder 60 will also result in the second and third holders 62,64 moving towards one another and engaging opposed sides of the article 52. In this position, the article 52 will be clamped into position by the clamping action of the second and third holders 62,64.

It should be noted that more than 180° of the third article 52 is surrounded by the clamping elements of the second and third holders 62,64 and the first holder 60. This encircling of the article 52 will help to hold it in position. The weight of the third article 52 along with the weight of the first rack 10 will help hold the first and second articles 48,50 in position. The weight of the third article 52 is transferred to these underlying articles 48,50 through the flexible strap and the clamping elements of the second and third holders 62,64.

The second and third holders 62,64 have upper seats for receiving articles 54 and 56. The articles 54 and 56 can be placed in their respective holders in any order. After the articles 54 and 56 are placed in the first rack 10, a second rack 10 can be placed on the top of these articles 54,56. In other words, the fourth article 54 can have a second holder 68 placed thereon while the fifth article 56 can have a third holder 70 placed thereon. Between the second and third holders 68,70 is a first holder 66. This first holder 66 is a strap made of flexible material in the embodiment of FIG. 3. This upper rack 10 having holders 66, 68 and 70 corresponds to the previously described rack 10.

Figure 4:
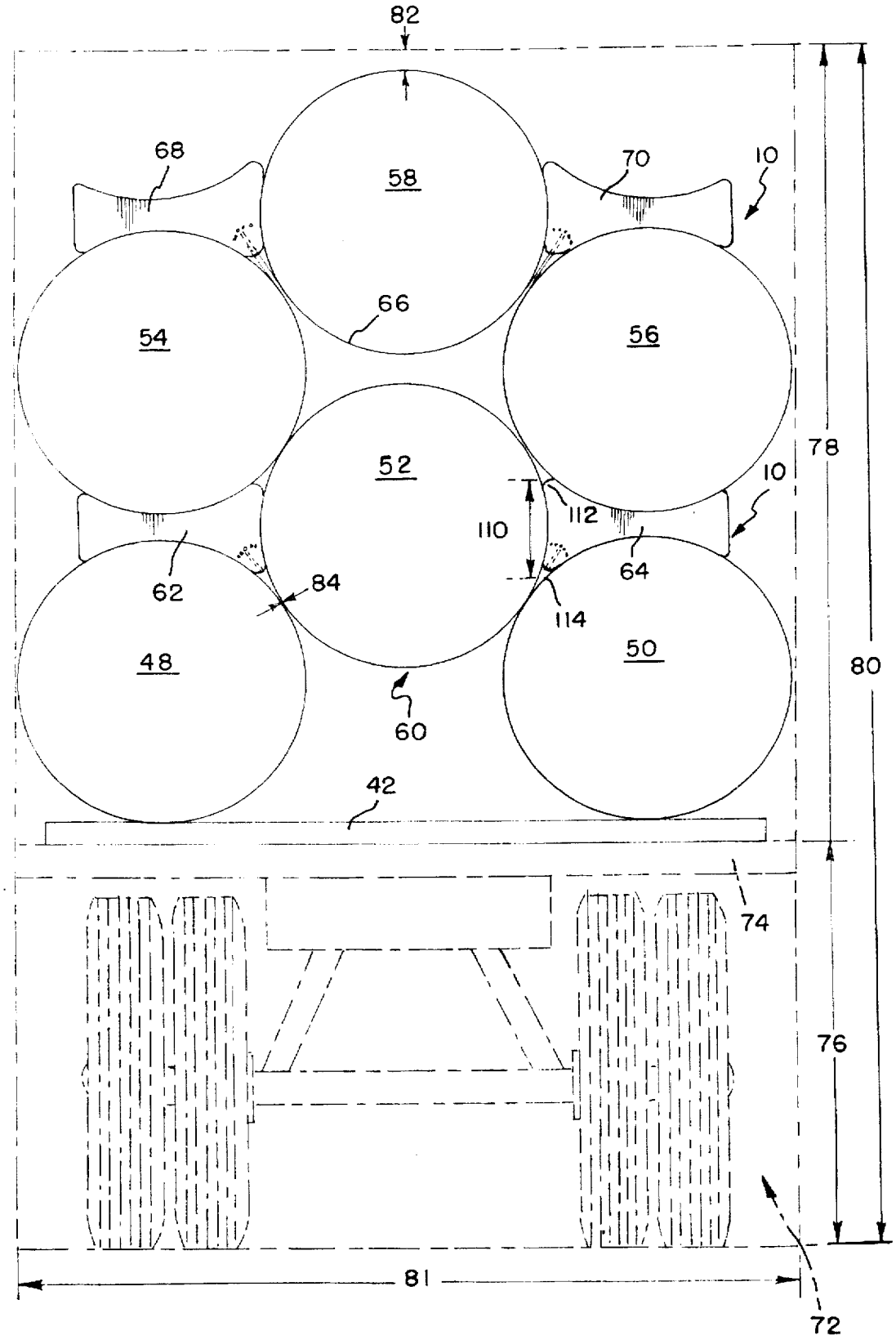
FIG. 4 is an end view of a vehicle similar to FIG. 3 showing a sixth article loaded into position.

In the arrangement shown in FIG. 3, a sixth article 58 is beginning to be placed on the first holder 66 of the upper rack 10. Transferring the weight of the sixth article 58 to the first holder 66 will cause the second and third holder 62,64 to move to the position as shown in FIG. 4. Also, the strap of the first holder 66 will assume an arcuate position as shown in FIG. 4. The clamping seats on the sides of the second and third holders 68,70 will move into engagement with the sides of the sixth article 58. More than 180° of the outer periphery of the sixth article 58 will be enclosed by the clamping seats of the second and third holders 68,70 and the first holder 66. This will help to prevent disengagement and release of the sixth article 58. However, if the sixth article 58 is merely lifted from the first holder 66, it can easily be removed therefrom. The upper rack 10 is then removed and then the fourth and fifth articles 54,56 can be easily unloaded. The third article 52 is then removed whereafter the lower rack 10 is removed. Then, the first and second articles 48,50 can easily be removed. One person can easily load and unload the articles in the rack 10 of the present invention.

As indicated in FIG. 4, the racks 10 may be mounted on the bed of the vehicle 72. Of course, these racks can instead be used on a train, boat, or any other type of vehicle, or can simply be stacked in a warehouse or other storage location. The bed 74 of the truck 72 is shown as being slightly larger than the support 42. However, the support 42 can be larger than the bed 72 or can be the same size as this bed. Also, as noted above, the support 42 can be omitted and the article stacked directly on the bed 74 or other surface. From the ground or roadway to the top of the bed 74 is a first distance 76. Then, from the top of the bed 74 to a second predetermined height, is a second distance 78. The two distances 76 and 78 added together give a third distance 80. This third distance 80 can be a height of 13 feet 6 inches. This height is a maximum for a load on a truck which is set by law. Bed heights can vary but the maximum bed height 76 will typically be 57 inches. Therefore, from the top of the bed to the top of the stack should only be a maximum height of 105 inches in order to fit in this legally set envelope. Also, the total width 81 of the bed must be within 102 inches. Therefore, it should be noted that the articles 48, 50, 54 and 56 do not overhang the edge of the bed and therefore remain in this width envelope of 102 inches. The centers of the articles 48 and 50 or 54 and 56 can be spaced sixty-four and three-eighths inches apart. A top clearance 82 of three and thirty-five/sixty four ($3\frac{35}{64}$) inches can be obtained between the top of the sixth article 58 and the top of the legally set height. While certain dimensions have been set forth, they should not be considered as limiting the invention.

Regulations therefore dictate a certain envelope in which a load on a truck must fit. The rack system of the instant invention easily accommodates this load while holding six articles therein. Heretofore, it has only been possible to load five articles within this legally set envelope with conventional racking systems. The instant invention maximizes the available space of the envelope to accommodate six articles 48 through 58. A twenty percent increase of articles per load can therefore be obtained with the present invention.

The strap 18 of the first and second holders 60,66 is contemplated as being a flexible material with a thickness of one-eighth of an inch as previously noted. Because the strap width is doubled, there is a one-fourth inch thickness between the two tanks 48,52 for example, as indicated by arrows 84. This slight thickness minimizes the overall height of the stack of articles while slightly spacing adjacent articles from one another. In this manner, the articles such as 48,52 will not touch and therefore scratching or other damage to the articles can be avoided. The straps themselves act as a padding material for protection of the articles.

Figure 5:
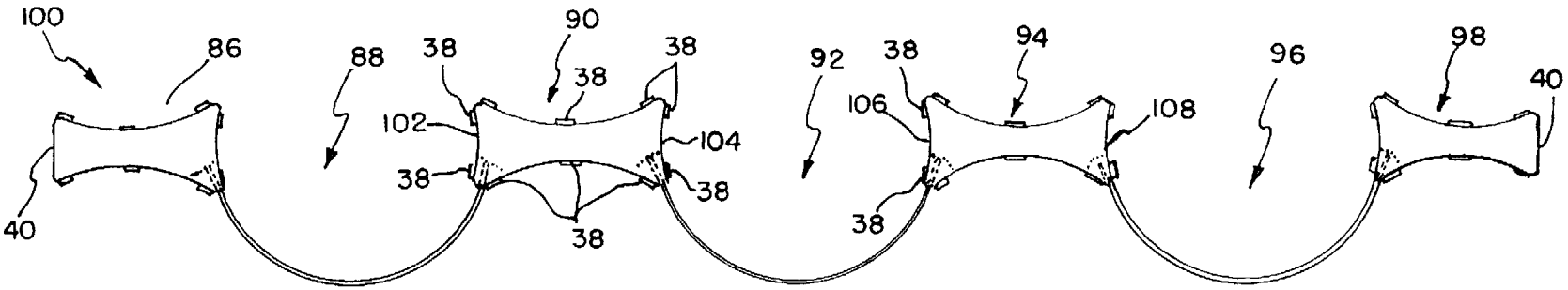
FIG. 5 is a modified form of the rack of the present invention.

Turning to FIG. 5, a further embodiment of the present invention is shown. In this arrangement, rack 100 comprises a series of holders 86, 88, 90, 92, 94, 96 and 98. Basically, holders 86, 90, 94 and 98 correspond to the rigid clamping elements formed by the second and third holders 14,16. The two outermost holders 86 and 98 can have the same configuration as the second and third holders 14,16 described above. However, the inner holders 90,94 have concave clamping seats 102, 104, 106 and 108 on each side thereof. While flat end pieces 40 are shown on the outer rigid holders 86,98, concave clamping seats could also be used. However, it is contemplated that on the outermost holders, articles would not be engaged by such clamping seats. Such concave clamping seats on outermost holders 86,98 would merely result in uniform clamping elements being utilized, thereby obviating the need for different shaped clamping elements. Between each of the clamping elements of the holders 86, 90, 94 and 98, flexible straps forming the holders 88, 92 and 96 are provided. These holders 88, 92 and 96 correspond to the above-described first holder 12.

In the FIG. 5 arrangement, four articles can be held beneath the rack 100. Three articles can be held in the holders 88, 92 and 96 and four articles can be stacked on the upper seats of the holders 86, 90, 94 and 98. Similar to the other embodiments, when articles are placed in holders 88, 92 and 96, their weight will cause the clamping seats on holders 86, 90, 94 and 98 to engage the sides thereof. Therefore, the articles in these seats 88, 92 and 96 can be firmly held in position.

While four articles are being held in the first row, three articles in the second row and four articles in the third row of the FIG. 5 embodiment, it should be appreciated that any number of holders can be strung together in order to accommodate any desired number of articles per row. Also, articles resting in the upper seats of holders 86, 90, 94, 98 can also receive additional racks such that further rows of articles can be provided. In fact, racks such as those shown in FIGS. 2 and 5 can be combined or any other suitable combination of racks can be.

Figure 6:
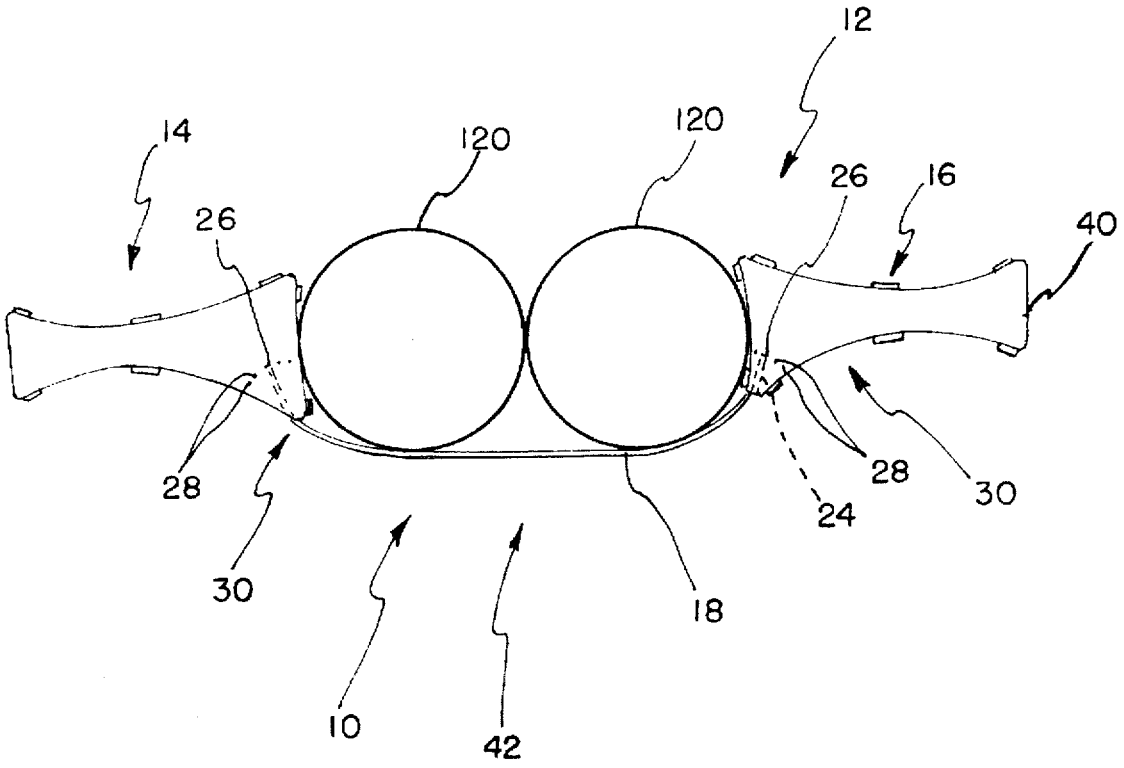

As a further modification, it is contemplated that more than one article could be placed in the strap 18. For example as seen in FIG. 6, in the first holder 12, two or more articles 120 can be placed side-by-side, the weight of the articles and rack on top of a particular row of articles holds the plurality of articles on strap 18 in position. One or more straps can encircle the entire load to aid in holding any of the articles in the uppermost row in position. Other than the first holder 12, any of the holders 88, 92 or 96 of the embodiment of FIG. 5 can also have one or more articles loaded therein. This arrangement is useful when articles having a size smaller than that for which the rack is designed are being handled. Other modifications to the rack 10, 100 are also contemplated and should be construed as being within the scope of the appended claims.

In FIGS. 3 and 4, four rows of articles are shown. It should be contemplated that additional rows of articles can be obtained. When handling 500-lb. propane tanks, their diameter is such that when more than four rows of articles are stacked, the height of the stack will exceed the legally set height 80 when the trucks are mounted on the tallest available truck bed. However, if smaller diameter tanks are used, many more rows of articles can be placed on the truck bed. Of course, if the racks are being used on a ship, train or in a storage facility such as a warehouse, there is no such legally imposed limit. Therefore, more than four rows of articles can be stacked.

While the strap 18 has been described as being made from a flexible material, it should be appreciated that a relatively rigid strap which is hinged to the second and third holder 14,16 could instead be used. The rigid strap could be made from an inflexible metal. This hinged strap arrangement is considered as a flexible strap due to the hinged arrangement. Upon placing an article on this metal strap, the two holders 14,16 would move towards one another in order to clamp the article into position. It is preferred, however, that this strap 18 be made of a flexible material as previously described.

The clamping means 37 and the flexible strap 18 will surround more than 180° of the outer periphery of the article in the first holder 12 as noted above. However, it is contemplated that less than 180° of the outer periphery of the article can be surrounded. Then, the article would merely need be vertically lifted from the first holder during unloading. There would be no need to have the movement of the second and third holders 14,16 away from one another. Pivoting of the first holder 12 relative to the second and third holders 14,16 and/or the use of flexible material for strap 18 need not be done if less than 180° of the outer periphery of an article is to be surrounded.

When using a rack 10 of the present invention, a self-gripping rack and article combination is formed. Flexible means, including strap 18, will receive an article such as third article 52. On each end of the strap 18, the clamping elements or holders 14,16 form clamping means 37 for engaging the article on the flexible strap in response to the loading of the article on the strap. The clamping means 37 includes the rigid clamping elements formed by the clamping seats 36. The sides of each of these clamping elements will engage the sides of the article. The seat means such as upper or lower seat 34,32 are provided on the clamping elements or holders 14,16 for receiving and holding additional articles.

A method is also provided with the instant invention for stacking articles. This method comprises placing a first article 48 on a support 42. Of course, other than a readily detachable support 42, the ground, bed of the truck, bed of the train, or any other structure can be considered as the support. A second article 50 is also placed on the support spaced from the first article 48. A clamping element such as rack 10 is placed on the articles 48,50. The lower concave seats 32 of the clamping elements will only engage a portion of an outer periphery of the first and second articles 48,50. A flexible strap such as the holder 60 is provided between the second and third holders 62,64. The third article 52 will then be clamped by moving the two clamping elements into engagement with sides of the third article. The weight of the third article 52 will cause this movement.

It has been noted throughout the discussion that concave seats such as 34,32 have been discussed. It should be appreciated that v-shaped seats can instead be used for receiving the articles. In this manner, different diameters articles could be accommodated. Of course, different seats having different curvatures can be used in order to accommodate different sized and shaped articles.

While FIGS. 3 and 4 only show an upper and lower set of racks 10, it should be appreciated that any number of racks can be used along the length of each of the articles. For example, a lower rack 10 can be provided at the front and rear of each article such that there are two racks between the first and second row of articles. Similarly, the truck bed 44 can have a certain length such that more than one stack of articles can be placed thereon. In other words, articles can be placed end to end with their longitudinal axes generally aligned in a stack. These series of stacks of articles can be on the bed of the truck or any other suitable support. For each stack of articles, any desired number of racks per row can be utilized.

With the rack and method of the instant invention, an increased number of articles can be accommodated in a stack. For example, in the prior art, it has only been possible to stack five propane tanks on a bed of a truck when five hundred gallon tanks are handled. With the present invention, it is possible to get six articles on the truck within the legally set envelope. It is also possible to ship articles in the present invention without damage. The pads 38 and material of the flexible straps 18 can prevent scratching or other damage to the articles. The articles will not engage one another such that banging and subsequent damage to the articles will be prevented.

Conventionally, racks used to ship propane containers weight 125 pounds. The racks of the instant invention having clamping means 37 can weigh around twenty-five pounds. This is a considerable weight savings for the stack of the instant invention. Fuel consumption, when transporting the articles, can be reduced.

The racks of the instant invention are easy to load and unload and will effectively hold the load in a safe manner. There is no danger of the articles tipping from the rack when the vehicle goes around the curve.

Moreover, when a vehicle suddenly stops, there is a tendency for a stack to tip forwardly. In the view seen in FIG. 4, a rear of the vehicle is shown. When the vehicle would stop, especially when the vehicle suddenly stops, there is a tendency for the articles to try and lift so that they tip towards the cab. The self-gripping arrangement of the instant invention counter-balances these forces in order to prevent such tipping. As shown in FIG. 4, a certain distance 110 is indicated. When the vehicle stops suddenly, a forward force (into the page) is applied at point 112, which urges the article to tip over. This point would be at the upper contact between the rigid holder 14 or 16 and the article. A similar force is also applied on the articles hold by strap 18 throughout the stack. However, due to the self-gripping nature of the rack of the instant invention, a counter-balancing force is applied in area 114 towards the rear of the vehicle. This point 114 is a contact point between the lower end of holder 14 or 16 and the article on strap 18. In other words, a forward force $F_1$ applied at point 112 is counter-balanced by a rearward force $F_2$ applied at point 114. The force $F_1$ times the distance 110 equals the force $F_2$ times the distance 110. This counterbalancing force will aid in preventing tipping of the stack of articles. Therefore, articles can safely be transported with the rack of the present invention.

While only the forces acting on the right-hand side of the third article 52 have been discussed, similar forces also act on the left-hand side of this article as well as the sixth article 58. This counterbalancing arrangement helps to prevent forward tipping of the stack of articles. The downward force of the weight of the various articles 58, 54, 56 and 52 and racks 10 also helps to maintain the integrity of the entire stack. The present invention therefore provides for a rack which can safely transport articles in a manner heretofore unattainable with the prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A rack having a plurality of holders for receiving articles in seats thereon, a first holder being positioned between a second and third holder, the first holder having a seat facing a first direction and the second and third holders each having at least one lower, arcuate seat facing a second direction and at least one side arcuate seat, the first direction being opposite to the second direction, the first holder being readily flexible and the second and third holders being rigid, the at least one side seat of each second and third holder being generally perpendicular to the at least one lower seat, the lower seats being adapted to engage a different article than the side seats.

2. The rack according to claim 1, wherein the seats on at least the second and third holder are concave and wherein the holders are generally linearly aligned.

3. The rack according to claim 1, wherein the second and third holders further have clamping seats, the clamping seats being on a side of each of the holders which is generally perpendicular to a side having the seat facing the second direction, the clamping seat on the second holder being opposed to the clamping seat on the third holder and both of the clamping seats being engageable with sides of an article in the seat of the first holder.

4. The rack according to claim 3, wherein the seat on the first holder and the clamping seats have a length sufficient to surround more than 180 degrees of a periphery of an article on the first seat and wherein both of the clamping seats are concave.

5. The rack according to claim 1, wherein the second and third holders each further have upper seats, the upper seats facing the first direction, articles being receivable in the upper seats.

6. The rack according to claim 5, further comprising pads on each of the lower seats and the upper seats of each of the second and third holders, the pads being engageable with articles held by the holders.

7. The rack according to claim 1, further comprising a plurality of pads provided in the seats of both the second and third holders, the pads being engageable with articles held by the holders.

8. The rack according to claim 1, wherein the rigid second and third holders each have concave upper and lower seats and at least one concave clamping seat on a side thereof and wherein the flexible first holder comprises a strap extending between the sides of the third and second holders having the clamping seats.

9. The rack according to claim 1, wherein the first holder is a flexible strap extending between the second and third holders, an article being receivable on an upper surface of the flexible strap.

10. The rack according to claim 1, further comprising a fourth and fifth holder, the fourth holder being flexible and the fifth holder being rigid, the fourth holder being connected between the third and fifth holder and having a seat facing the first direction, the fifth holder having at least one seat, the at least one seat of the fifth holder facing the second direction.

11. The rack according to claim 1, wherein the rack is mountable on a movable vehicle and wherein a second rack can be placed on articles in the holders such that a stack of articles can be formed, the seats on at least the second and third holder of each rack being concave and nondeformable.

12. The rack according to claim 1, further comprising means for adjusting a length of the first holder.

13. The rack according to claim 1, wherein the first holder is adapted to receive more than one article.

14. A self-gripping rack and article combination comprising:

at least one article;

flexible means for receiving the article, the flexible means including a flexible strap having two ends;

clamping means for engaging the article on the flexible strap in response to loading of the article on the strap, the clamping means including a rigid clamping element on each end of the flexible strap, a side of at least one of the clamping elements engaging a side of the article, the clamping elements moving toward one another in response to loading of the article on the strap in order to engage the article; and seat means on each of the clamping elements for receiving and holding additional articles.

15. The self-gripping rack and article combination according to claim 14, wherein the flexible strap and the sides of the clamping elements engaged with the article surround more than 180 degrees of a periphery of the article.

16. The self-gripping rack and article combination according to claim 14, wherein the article on the flexible strap and the additional articles held by the seat means are on opposite sides of the rack.

17. The self-gripping rack and article combination according to claim 14, wherein the article on the flexible strap is on top of the rack and wherein the seat means are at least on an underside of the clamping elements such that the rack is between the article on the flexible strap and the additional articles in the seat means and wherein the seat means includes a concave seat on each of the clamping elements for receiving one of the additional articles.

18. The self-gripping rack and article combination according to claim 14, wherein the sides of the clamping elements are movable toward and into engagement with the article when the article is loaded on the flexible strap.

19. The self-gripping rack and article combination according to claim 14, wherein each of the clamping elements has an upper seat and a lower seat, one of the additional articles being receivable in each of the seats.

20. The self-gripping rack and article combination according to claim 14, wherein each of the clamping elements has an upper seat and a lower seat, and wherein at least three rows of articles are provided, a first row of articles being received and held in the lower seats of the clamping elements, a second row being held on the flexible strap and a third row being received and held in the upper seats of the clamping elements.

21. The self-gripping rack and article combination according to claim 20, further comprising a second set of clamping elements with a flexible strap therebetween, the second set of clamping elements being positioned on top of the third row of articles, each of the second set of clamping elements having at least a lower seat for receiving an article in the third row and the combination further comprising a fourth row having at least one article, the at least one article in the fourth row being held by the flexible strap between the second set of clamping elements.

22. The self-gripping rack and article combination according to claim 21, wherein a height of the combination having four rows of articles is less than or equal to 105 inches.

23. The self-gripping rack and article combination according to claim 21, further comprising an additional clamping element connected to one of the clamping elements between the first and second rows of articles, the additional clamping element being connected to the one clamping element by a flexible strap, the additional element having at least a lower seat and the combination further comprising a first additional article in the lower seat of the additional clamping element and a second additional article on the strap extending from the additional clamping element, the first additional article being in the first row of articles and the second additional article being in the second row of articles.

24. The self-gripping rack and article combination according to claim 14, wherein the clamping elements are first and second clamping elements and wherein the seat means includes an upper and lower seat on each of the first and second clamping elements and wherein the combination further comprises:

an additional clamping element connected to the second clamping element by a second flexible strap;

a first additional article in the lower seat of the second clamping element; and a second additional article on the second flexible strap.

25. The self-gripping rack and article combination according to claim 24, further comprises further clamping elements sequentially interconnected with flexible straps for adding additional articles to a row.

26. The self-gripping rack and article combination according to claim 14, further comprising means for adjusting a length of the flexible strap.

27. The self-gripping rack and article combination according to claim 14, further comprising a support underlying the additional articles held by the seat means, the support having indentations for receiving the articles.

28. The self-gripping rack and article combination according to claim 14, wherein the combination is mountable on a movable vehicle and wherein the seat means includes concave sides on the rigid clamping elements for engaging the article on the strap.

29. The self-gripping rack and article combination according to claim 14, further comprising a plurality of pads on the clamping elements for engaging the article and the additional articles.

30. The self-gripping rack and article combination according to claim 14, wherein more than one article is received in the flexible strap.

31. The self-gripping rack and article combination according claim 14, wherein the flexible strap engages at least an underside of the article but remains out of contact with a top of the article.

32. A method for stacking articles comprising the steps of:

placing a first article and a second article on a support, the first and second articles being spaced apart;

placing a clamping element on top of each of the articles, the clamping elements only engaging a portion of an outer periphery of the first and second articles;

providing a flexible strap between the two clamping elements;

placing a third article on the flexible strap between the two clamping elements; and clamping the third article with the two clamping elements by moving the two clamping elements into engagement with sides of the third article, weight of the third article moving the clamping elements into engagement therewith.

33. The method according to claim 32, further comprising the step of placing a fourth article on one of the clamping elements which is on top of one of the first and second articles.

34. The method according to claim 32, further comprising the steps of:

placing a fourth article on the clamping element which is on top of the first article; and placing a fifth article on the clamping element which is on top of the second article, all of the articles forming a stack.

35. The method according to claim 34, further comprising the steps of:

placing a third clamping element on top of the fourth article and placing a fourth clamping element on top of the fifth article;

providing a flexible strap between the third and fourth clamping elements;

placing a sixth article on the flexible strap between the third and fourth clamping elements; and clamping the sixth article with the third and fourth clamping elements by moving the clamping elements into engagement with sides of the sixth article, weight of the sixth article moving the third and fourth clamping elements into engagement therewith.

36. The method according to claim 35, wherein the third and fourth clamping elements only engage a portion of an outer periphery of the fourth, fifth and sixth articles and wherein the method further comprises the step of transferring the weight of the sixth article to underlying articles through the flexible strap and the third and fourth clamping elements such that a downward force is exerted on the underlying articles by the sixth article; and holding all of the articles in position due, in part, to both the steps of clamping and transferring weight.

37. The method according to claim 32, further comprising the step of placing a hold-down strap around at least the first, second and third articles to further hold the articles in position.

38. The method according to claim 32, wherein the step of placing the first and second articles comprises loading the articles on a movable vehicle.

39. The method according to claim 32, wherein the third article has a generally cylindrical shape and wherein the method comprises enclosing more than 180 degrees of an outer periphery of the third article by the flexible strap and by sides of the clamping elements on the first and second articles.

40. The method according to claim 32, further comprising the step of adjusting a length of the flexible strap between the clamping elements.

41. The method according to claim 32, wherein the clamping elements are first and second clamping elements and wherein the method further comprises the steps of:

providing an additional clamping element connected to the second clamping element by a second flexible strap;

placing a first additional article on the support, the first additional article being spaced from the first and second articles;

placing the additional clamping element on the first additional article;

placing a second additional article on the second flexible strap; and clamping the second additional article with the second and additional clamping elements.

42. The method according to claim 41, wherein the first article, the second article and the first additional article are generally in a same plane when placed on the support and wherein the steps of placing the first additional article on the support is carried out either before or after the step of placing the clamping elements on the first and second articles.

43. The method according to claim 42, wherein the third article and the second additional article are generally in a same plane when placed on the respective flexible straps and wherein the method further comprises the step of providing further clamping elements sequentially interconnected with flexible straps for adding additional articles to a row.

44. The method according to claim 41, wherein the first article, the second article and the first additional article are in a first row and wherein the third article and the second additional article are in a second row, the method further comprising the steps of:

forming a third row of articles by placing one article on top of each of the clamping elements;

placing additional clamping elements on top of each article in the third row, only one clamping element being placed on each article in the third row and each of the clamping elements being sequentially interconnected by a series of straps;

placing additional articles on the second series of straps to form a fourth row of articles, all of the articles forming a stack.

* * * * *